US005489746A

United States Patent [19]

Suzuki et al.

[11] Patent Number: 5,489,746

[45] Date of Patent: Feb. 6, 1996

[54] DATA STORAGE AND GENERATION DEVICE HAVING IMPROVED STORAGE EFFICIENCY

[75] Inventors: Hideo Suzuki; Kazuhisa Okamura, both of Hamamatsu, Japan

[73] Assignee: Yamaha Corporation, Japan

[21] Appl. No.: 445,587

[22] Filed: May 22, 1995

Related U.S. Application Data

[63] Continuation of Ser. No. 623,129, Dec. 6, 1990, abandoned.

[30] Foreign Application Priority Data

Dec. 9, 1989 [JP] Japan ..... 1-319601

[51] Int. Cl.[6] ..... G10H 7/00

[52] U.S. Cl. ..... 84/602; 364/245.1

[58] Field of Search ..... 84/601–607, 622, 84/627; 341/95; 364/245.1, 254.9, 715.02

[56] References Cited

U.S. PATENT DOCUMENTS

| | | | |
|---|---|---|---|
| 4,406,203 | 9/1983 | Okamoto et al. | 84/609 |
| 4,449,536 | 5/1984 | Weaver | 364/417 |
| 4,523,276 | 6/1985 | Maejima et al. | 364/200 |
| 4,584,921 | 4/1986 | Wachi | 84/605 |
| 4,654,781 | 3/1987 | Schwartz et al. | 364/200 |
| 4,744,281 | 5/1988 | Isozaki | 84/602 |
| 4,785,702 | 11/1988 | Katoh | 84/604 |
| 4,809,577 | 3/1989 | Fujita | 84/1.01 |
| 4,833,595 | 5/1989 | Iijima | 364/200 |
| 4,866,636 | 9/1989 | Fukami et al. | 364/715.02 X |
| 4,876,937 | 11/1989 | Suzuki | 84/612 |
| 4,885,584 | 12/1989 | Dalrymple | 341/95 X |
| 4,916,996 | 4/1990 | Suzuki et al. | 84/603 |
| 4,975,835 | 12/1990 | Hidaka et al. | 364/200 |
| 5,081,897 | 1/1992 | Takauji | 84/604 |
| 5,113,740 | 5/1992 | Saito | 84/607 |
| 5,347,478 | 9/1994 | Suzuki et al. | 364/715.02 |

*Primary Examiner*—William M. Shoop, Jr.
*Assistant Examiner*—Jeffrey W. Donels
*Attorney, Agent, or Firm*—Graham & James

[57] ABSTRACT

Data of desired variable data length is stored in a memory. When desired data is to be taken out of the memory, data length of the data to be taken out is designated and necessary data is selectively taken out of the memory in accordance with the designated data length. Single data may be stored over plural addresses. In that case, MSB or LSB of data to be taken out of the data stored over the plural addresses is pointed out and desired data of a desired bit number is taken out in accordance with the pointed out position and the bit number of the data. In the memory, first data and second data may be mixedly stored. The second data consists of plural bits and is divided in plural sections, each section being separately stored in the first data. The first data and the second data are separated from the data which has been read from the memory and the respective sections of the second data are assembled together to reproduce completed second data. This storage and reproduction of data contributes to an efficient utilization of the memory.

23 Claims, 7 Drawing Sheets

DATA TAKEOUT & REPRODUCTION SECTION 20

DATAPOSITION REPRODUCTION CIRCUIT 34

DATA ADJUSTMENT CIRCUIT 36

COMPRESSED DATA DEMODULATION CIRCUIT 23

DATA STORAGE AND GENERATION DEVICE HAVING IMPROVED STORAGE EFFICIENCY

This is a continuation of application Ser. No. 07/623,129 filed on Dec. 6, 1990, now abandoned.

BACKGROUND OF THE INVENTION

This invention relates to a data generation device for an electronic musical instrument and, more particularly, to a data generation device which can be used for generating, for example, waveform data, envelope data, tone color parameter data and other various parameter data and in which the manner of storing and reading out data is improved and an efficient utilization of a data memory is thereby realized.

The prior art concept for realizing an efficient utilization of a data memory was to adopt a compressed data representation system instead of a normal PCM system as a representation form of data stored in the data memory. U.S. Pat. No. 4,916,996, for example, discloses storage of tone waveform data which is compressed by employment of the linear prediction coding system (LPC). U.S. Pat. No. 4,809,577 also discloses waveform data compression technique.

In the prior art data storage device employing data compression as well as the conventional data storage device for the PCM system data, data is stored at each memory address at one to one relation and data length (data size, i.e., the bit number constituting single data) of data stored therein is fixed to a certain number. For example, it is normal for single data having data length of 16 bits to be stored in an address of 16 bits. As a special usage of a memory, an address of 16 bits is divided, for example, into two sections each having 8 bits and different 8-bit data are stored respectively in these memory sections. Even in this case, however, each data to be stored has fixed data length of 8 bits.

In the prior art devices in which data is stored with fixed data length, storage cells of a memory are wasted when used for data whose effective bit number is smaller than the fixed data length. In a case where, for example, tone waveform data is stored so that its maximum amplitude value may be covered with fixed data length of 16 bits, there occurs a case where the number of effective bits is only 2 bits or 3 bits at a sample point at which the amplitude value is relatively small. In such a case, storage cells of 13 bits or 14 bits for one address are undesirably wasted. The storage cells thus wasted reaches an unignorable amount when viewing the entire memory. This constitutes factor which prevents efficient utilization of a memory and, therefore, prevents realization of a compact circuit design and reduction of manufacturing cost.

SUMMARY OF THE INVENTION

It is, therefore, an object of the invention to provide a data generation device for an electronic musical instrument capable of reducing the number of wasted storage cells and thereby realizing efficient utilization of a memory.

The data generation device for an electronic musical instrument, for achieving the above described object of the invention comprises a memory circuit for storing plural data having a desired variable data length, a data length designation circuit for designating data length of data to be read from the memory circuit, and a takeout circuit for selectively taking out necessary data from the memory circuit in accordance with the designated data length.

Data length of data stored in the memory circuit is not fixed but is made variable as desired. The data length of data to be taken out of the memory circuit is designated by the data length designation circuit. The takeout circuit selectively takes out necessary data from the memory circuit in accordance with the designated data length.

Since data length of data to be stored in a memory is not fixed but made variable as desired, storage cells of the number necessary for effective bits of the data only are occupied and unnecessary storage cells are not occupied. In other words, empty storage cells can be utilized for storing other data without being occupied. Accordingly, efficient use of a memory can be realized. Further, since data length of data to be taken out of a memory is designated, necessary data can be selectively taken out of the memory means in accordance with the designated data length, so that a problem in data takeout arising from adopting variable data length is solved and necessary data only can be taken out without any problem.

According to another aspect of the invention, a data generation device comprises a memory circuit storing single data of a desired bit number over plural addresses with a desired bit position in one address being used as a head position, a reading circuit for reading out data of all bits over the plural addresses from the memory circuit for taking out the single data, a point out circuit for pointing out the position of MSB or LSB of the data to be taken out of the data over the plural addresses which has been read by the reading circuit, and a takeout-circuit for taking out, in response to the position which has been pointed out by the point out circuit and the bit number of the data, the single data of the desired bit number from the data over the plural addresses which has been read by the reading circuit.

In this case, single data of a desired bit number is stored over plural addresses with a desired bit position being used as the head position. Plural data each having a desired bit number can therefore be stored efficiently as closely as possible without being restricted by the address unit. An efficient utilization of the memory can thereby realized.

According to still another aspect of the invention, a data generation device comprises a memory circuit for storing first data and second data mixedly, the second data consisting of plural bits and being divided into plural sections, each of the sections being stored separately in said first data, a reading circuit for reading out the data stored in the memory circuit address by address, a data separation circuit for separating the section of the first data and the section of the second data from the data which has been read out by the reading circuit, and a reproduction circuit for reproducing completed second data by assembling respective sections of the second data which has been separated by the data separation circuit.

The second data is separated into plural sections and stored separately in the first data, so that the second data is in a hidden state in the first data. This manner of storing the second data enables the second data to be packed efficiently in a suitable empty position of the first data, in compliance with various conveniences such as the bit number of the first data and the bit number of the address and therefore is advantageous for realizing an efficient utilization of the memory.

Preferred embodiments of the invention will be described hereinbelow with reference to the accompanying drawings.

BRIEF DESCRIPTION OF THE DRAWINGS

In the accompanying drawings.

DESCRIPTION OF PREFERRED EMBODIMENTS

Figure 1:
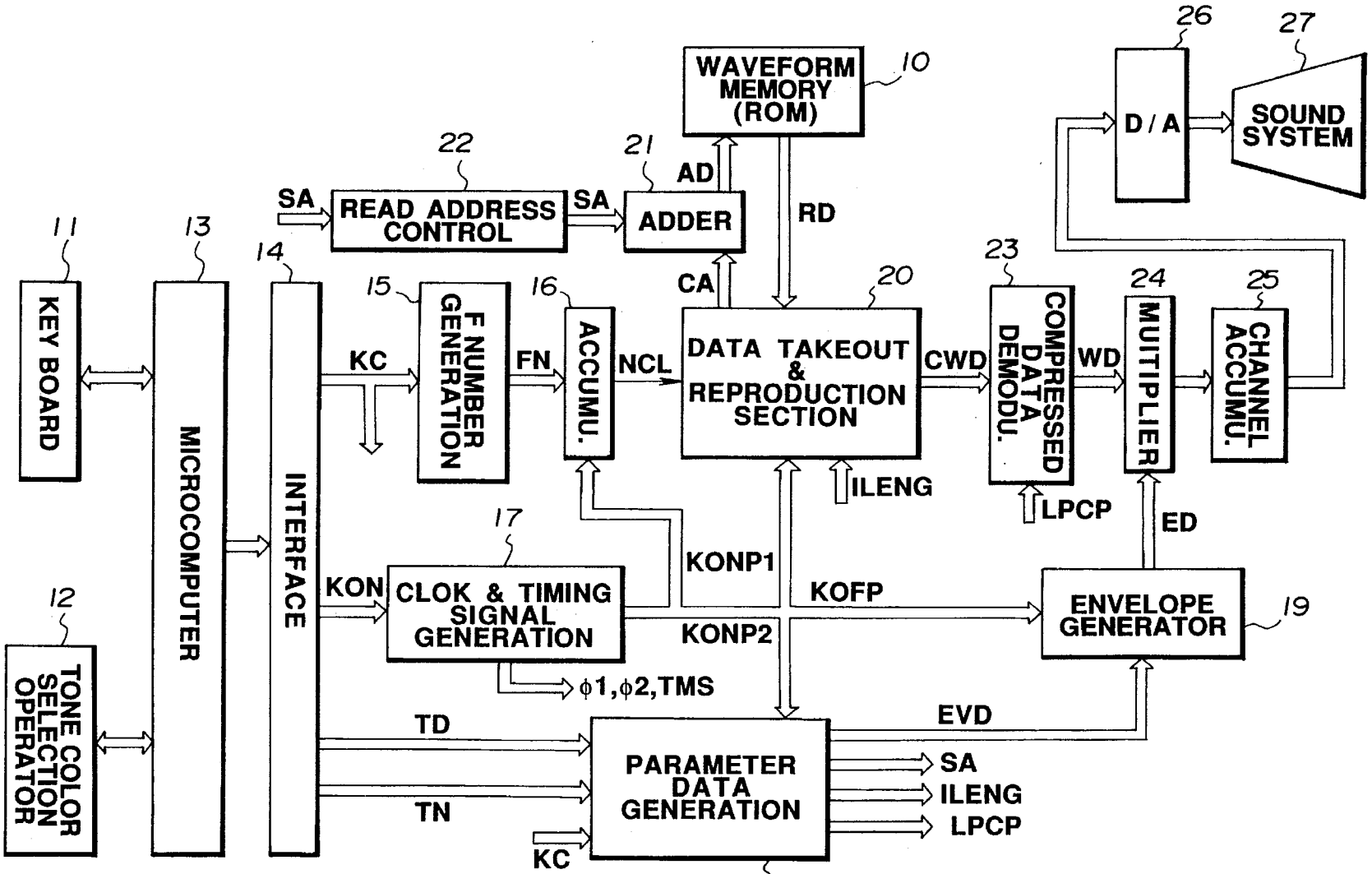
FIG. 1 is a block diagram showing the entire construction of an electronic musical instrument incorporating an embodiment of the invention.

In the electronic musical instrument shown in FIG. 1, the data generation device according to the invention is employed as a tone waveform generation device. More specifically, data is stored in a waveform memory 10 constructed of a ROM in a format according to an embodiment of the invention and data is read from this waveform memory 10 for reproduction of a tone by a method according to the embodiment.

Description of Variable Data and Hidden Bit

An example of a data format of data to be stored in the waveform memory 10 will be described first with reference to FIG. 2.

Figure 2:
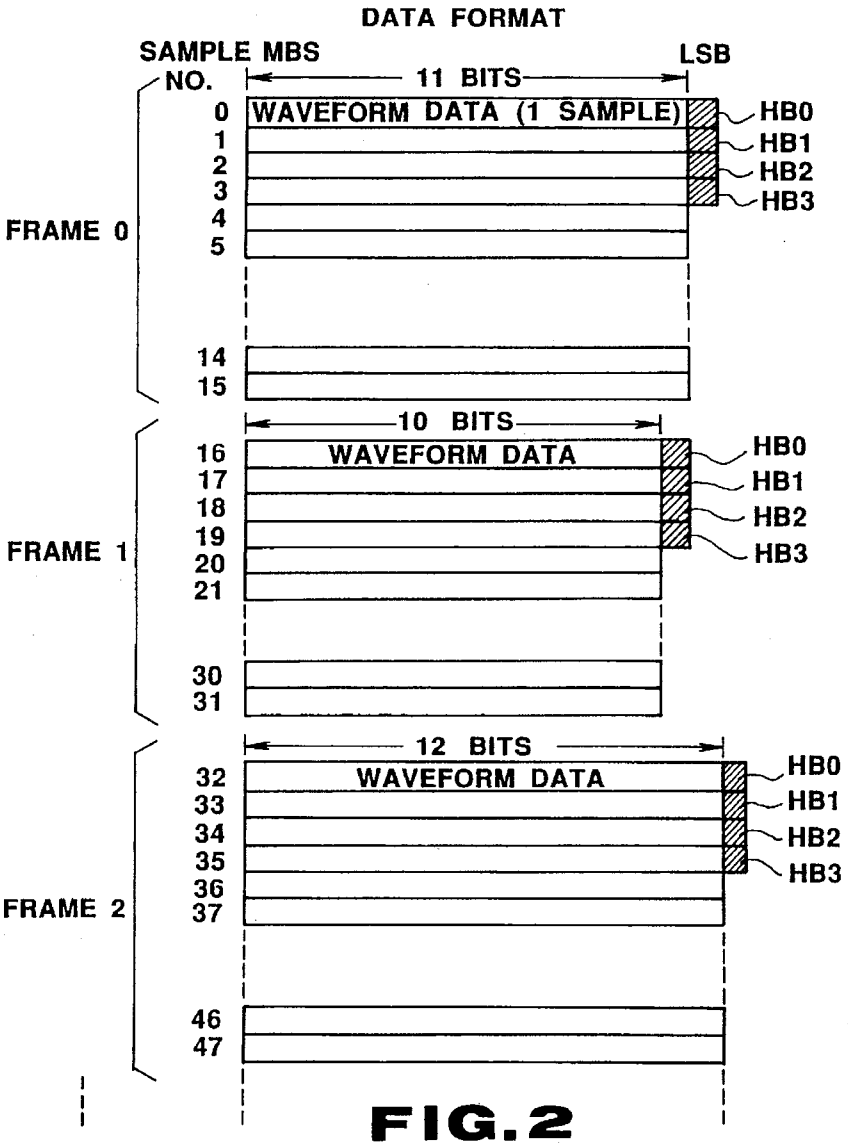
FIG. 2 is a diagram showing an example of data format of data stored in a waveform memory in FIG. 1.

FIG. 2 shows a data format of tone waveform data corresponding to a single tone color. The data format is divided into frames each of which consists of a data group for 16 sample points. The data length of these data is not constant but can be any length. In this embodiment, however, the data for 16 sample points in the same frame have the same data length. In FIG. 2, the size, i.e., data length, of waveform data belonging to the frame 0 is 11 bits, that of waveform data belonging to the frame 1 is 10 bits and that of waveform data belonging to the frame 2 is 12 bits.

In this embodiment, each of data for the first to fourth sample points (sample points 0 to 3) has extra one bit of "hidden bit" (HB0 to HB3) for "hidden information" in addition to the above described waveform data. The data having the hidden bits HB0 to HB3 for these sample points have a data length which is one bit larger than data for other sample points in the same frame. Without these hidden bits HB0 to HB3, i.e., as far as the size of substantial waveform data is concerned, all data in the same frame have the same size.

Each of the hidden bits HB0 to HB3 does not have apparent significance when it is kept in a separated state and contents of information are hidden. When these hidden bits HB0 to HB3 are aggregated together to form 4-bit information, the contents of the "hidden information" are exposed. In this embodiment, information designating data length is assigned as the "hidden information". More specifically, as "hidden information" in a certain frame, information designating data length of waveform data in the next frame is assigned. Weights of binary code of these hidden bits are in the order of HB3 (MSB), HB2, HB1 and HB0 (LSB).

In the example of FIG. 2, the contents of the hidden bits HB3 to HB0 in the frame 0 are "1010" and designate data length= 10 bits in the next frame 1. The contents of the hidden bits HB3 to HB0 in the frame 1 are "1100" and designate data length= 12 bits in the next frame 2. Since there is no preceding frame to the first frame 0, a suitable method may be employed for providing information for designating data length of the first frame such, for example, as storing information designating the data length of the first frame in a separate memory such as a tone color data memory.

Description of Data Storing Format

Figure 3:
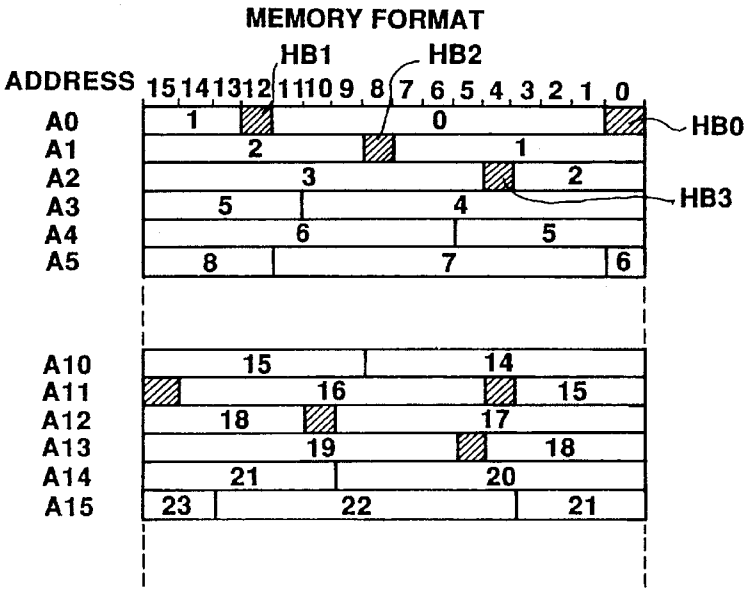
FIG. 3 is a diagram showing an example of memory format used when data having variable data length of the format shown in FIG. 2 is stored in the waveform memory in FIG. 1.

FIG. 3 shows an example of a memory format used in a case where data of variable data length composed of the format of FIG. 2 is actually stored in the waveform memory 10.

In the example of FIG. 3, the size, i.e., data length, of the memory address of the memory 10 is fixed at 16 bits per one address and each address is accessed by an address signal. Data for one sample point is not stored in one address, but plural data of variable data length are stored together as closely as possible in one address. For example, hidden bit HB0 accompanying the waveform data for the sample point 0 is stored at the LSB (least significant bit) of address A0, the waveform data for the sample point 0 is stored at 11 bits of higher or upper orders, hidden bit HB1 accompanying the waveform data for the sample point 1 is stored at a bit which is one bit higher, and 3 lower order bits of the waveform data for the sample point 1 are stored at 3 bits of higher orders of the address A0. The remaining 8 higher order bits of the waveform data for the sample point 1 are stored at 8 lower order bits of the address A1. In a similar manner, as shown in FIG. 3, waveform data and hidden bits for the respective sample points are stored closely together in the respective addresses. In FIG. 3, numerals in the address areas represent sample point numbers of the waveform data and shaded portions represent areas where the hidden bits are stored.

For storing data as closely as possible in the memory in an efficient manner, one data is suitably divided into plural portions and stored over plural addresses.

Any coding system may be employed for waveform data to be stored in the waveform memory 10. In the embodiment of FIG. 1, waveform data compressed by the linear prediction coding system (LPC) is stored in the waveform memory 10.

Waveform data to be stored in the waveform memory 10 may be data for waveform of one period or data for waveform of plural periods. As is well known, in a case where data for waveform of one period is stored, tone waveform data of plural periods can be obtained by repeatedly reading out the waveform data of one period. In a case where data of waveform of plural periods is to be stored, data of full waveform from the start of sounding of a tone to the end thereof may be stored or, alternatively, data of a full waveform of an attack portion and data of waveform of plural periods of a sustain portion may be stored. When the data of full waveform from the start of sounding of a tone to the end thereof is stored, waveforms of respective sample points may be read out once sequentially from the start address. When the data of full waveform of the attack portion and the data of waveform of plural periods of the sustain portion are stored, the data of the full waveform of the attack portion may be read out once sequentially from the start address and thereafter the data of waveform of plural periods of the sustain portion may be repeatedly read out. Since the above described reading control system is well known, detailed description thereof will be omitted herein. For convenience of explanation, it is assumed that in the embodiment of FIG. 1, a read address control circuit for the former reading control system is illustrated.

Description of the Entire Construction

Referring to FIG. 1, a keyboard 11 has a plurality of keys for designating tone pitches of tones to be generated. A tone color selection operator 12 has a plurality of operators for designating tone colors of tones to be generated. A microcomputer 13 detects depression and release of keys and a tone color selection state by scanning the keyboard 11 and the tone color selection operator 12 and performs an operation for assigning key depression information to any of a plurality (8 in this embodiment) of tone generation channels. The microcomputer 13 produces, for each channel, a key code KC representing a key which has been assigned to one of the tone generation channels and a key-on signal KON representing whether the assigned key is still being depressed or has been released. The microcomputer 13 produces also tone color number data TN representing a selected tone color and touch data TD representing key touch. The outputs of the microcomputer 13 are supplied to a tone source circuit through an interface 14. The interface 14 provides the key codes KC and the key-on signals KON of keys which have been assigned to the respective channels at a predetermined channel time divisional timing and also provides the tone color number data TN of the selected data and the touch data TD. In the figure, in the tone source circuit shown on the right side of the interface 14, various processing is performed for 8 channels on a time shared basis in response to data provided from the interface 14 and tone waveform signals for 8 channels are produced on a time shared basis.

An F number generation circuit 15 generates, in response to the key code Kc supplied from the interface 14, an F number FN which is a constant corresponding to a tone pitch frequency of a tone to be generated. The F number generation circuit 15 is constructed, for example, of a ROM or a table. This F number is accumulated repeatedly by an accumulator 16 and a carry signal from a suitably determined digit is provided as a note clock pulse NCL. This note clock pulse NCL corresponds to the tone pitch frequency of the tone to be generated and designates increment of the sample point at each pulse. This note clock pulse NCL, i.e., the sample point increment, constitutes a command given to the waveform memory 10 for reading out data of one sample point per one shot of pulse.

A clock and timing signal generation circuit 17 generates system clock pulses $\phi 1$ and $\phi 2$ and various other timing signals TMS and supplies these signals to the respective circuits and, in response to the key-on signal KON supplied from the interface 14, also forms and outputs key-on pulses KONP1 and KONP2 and a key-off pulse KOFP. The system clock pulses $\phi 1$ and $\phi 2$ are two-phase clocks and one period thereof corresponds to a time slot width of one channel. The key-on pulse KONP1 is a pulse which rises to "1" only once at a time slot of a certain channel when the key-on signal KON has risen from "0" to "1", i.e., at the start of depression of the key. The key-on pulse KONP2 is a pulse which rises to "1" only once at the time slot of the channel in next time division channel cycle after the key-on pulse KONP1 has risen to "1". The key-off pulse KOFP is a pulse which, when the key-on signal KON has fallen from "1" to "0", i.e., upon release of the key, rises to "1" only once at the time slot of the particular channel. These pulses are supplied to the respective circuits for controlling processing which are synchronized with the key-on and key-off.

A parameter data generation circuit 18 generates, in response to the tone color number data TN, touch data TD and the key code KC supplied from the interface 14, various parameter data for determining the tone color of the tone to be generated, performing a touch control and key scaling. Examples of parameter data generated in consideration of the selected tone color, key touch and key scaling are envelope setting data EVD for setting envelope, start address data SA for designating waveform reading start address, initial data length data ILENG for designating the data length of the first frame and LPC coefficient data LPCP for demodulating waveform data which has been compressed by the linear prediction coding system to PCM code data.

An envelope generator 19 forms and outputs, based on the key-on pulses KONP1 and KONP2, key-off pulse KOFP and the envelope setting data EVD, envelope shape data ED for the respective channels on a time shared basis.

A data takeout and reproduction section 20 performs, in response to the note clock pulse NCL supplied from the accumulator the sample point increment for identifying the sample point number of data to be read from the waveform memory 10 and identifies the address at which the data to be read out is stored on the basis of the sample point number and the data length of the data to be read out and thereby generates an address signal CA. This address signal CA is a relative address in a storage area storing waveform data corresponding to one tone color. An address signal CA which is generated by adding the start address data SA which is an absolute address to this relative address signal CA by an adder 21 is converted to an absolute address signal AD and this address signal AD is applied to the address input of the waveform memory 10.

A read address control circuit 22 receives the start address data SA generated by the parameter data generation circuit 18 and supplies this start address data SA to the adder 21. In a case where data of a full waveform from the start of sounding of a tone to the end thereof is stored in the waveform memory 10 and is read out only once, the read address control circuit 22 simply functions to supply the start address data SA to the adder 21. In a case where data of a full waveform of an attack portion and data of waveform of plural periods of a sustain portion are stored in the waveform memory 10 and the data of the waveform of the attack portion is read out once sequentially from the start of sounding of the tone to the end thereof and thereafter the data of the waveform of plural periods of the sustain portion is repeatedly read out, the read address control circuit 22 performs a more complicated address control. This address control however is well known, so that further description thereof will be omitted.

The waveform memory 10 provides, in response to the applied address signal AD, data of 16 bits from one memory address.

The data takeout and reproduction section 20 receives data RD of 16 bits which has been read from the waveform memory 10 and provides necessary data for one sample point of variable data length. In a case where necessary data for one sample point is stored over plural addresses, the data takeout and reproduction section 20 connects necessary data among read out data and provides the connected data.

The data takeout and reproduction section 20 further takes out data of "hidden bit" from among the data of 16 bits which has been read from the waveform memory 10 and provides a set of data HB0 to HB3 of 4 bits by connecting these data of hidden bits and thereby exposes the data length designation data LENG which has been stored as "hidden information" in the waveform memory 10. By utilizing this data length designation data LENG, data for one sample point of variable data length is taken out of the data of 16 bits which has been read from the waveform memory 10. In the first frame, data of variable data length for one sample point is taken out by utilizing the initial data length data ILENG supplied from the parameter data generation circuit 18.

The waveform data for one sample point which has been taken out in the above described manner is data compressed according to the LPC coding system. Therefore, the LPC coded waveform data which has been taken out of the data takeout and reproduction section 20 is applied to a compressed data demodulation circuit 23 and demodulated thereby to normal PCM coded waveform data WD. This waveform data WD is multiplied by envelope shape data ED from the envelope generator 19, so that its tone volume amplitude level is controlled in accordance with the envelope shape.

The reproduction and control of the waveform data to the multiplier 24 is performed for the respective channels on a time shared basis. The output of the multiplier 24 is accumulated by an accumulator 25 for the respective channels during one channel time division cycle whereby tone waveform data for all channels is obtained. The output of the accumulator 25 is converted to an analog signal by a digital-to-analog converter 26 and sounded acoustically through a sound system 27.

Description of the Data Takeout and Reproduction Section 20 in Detail

Figure 4:
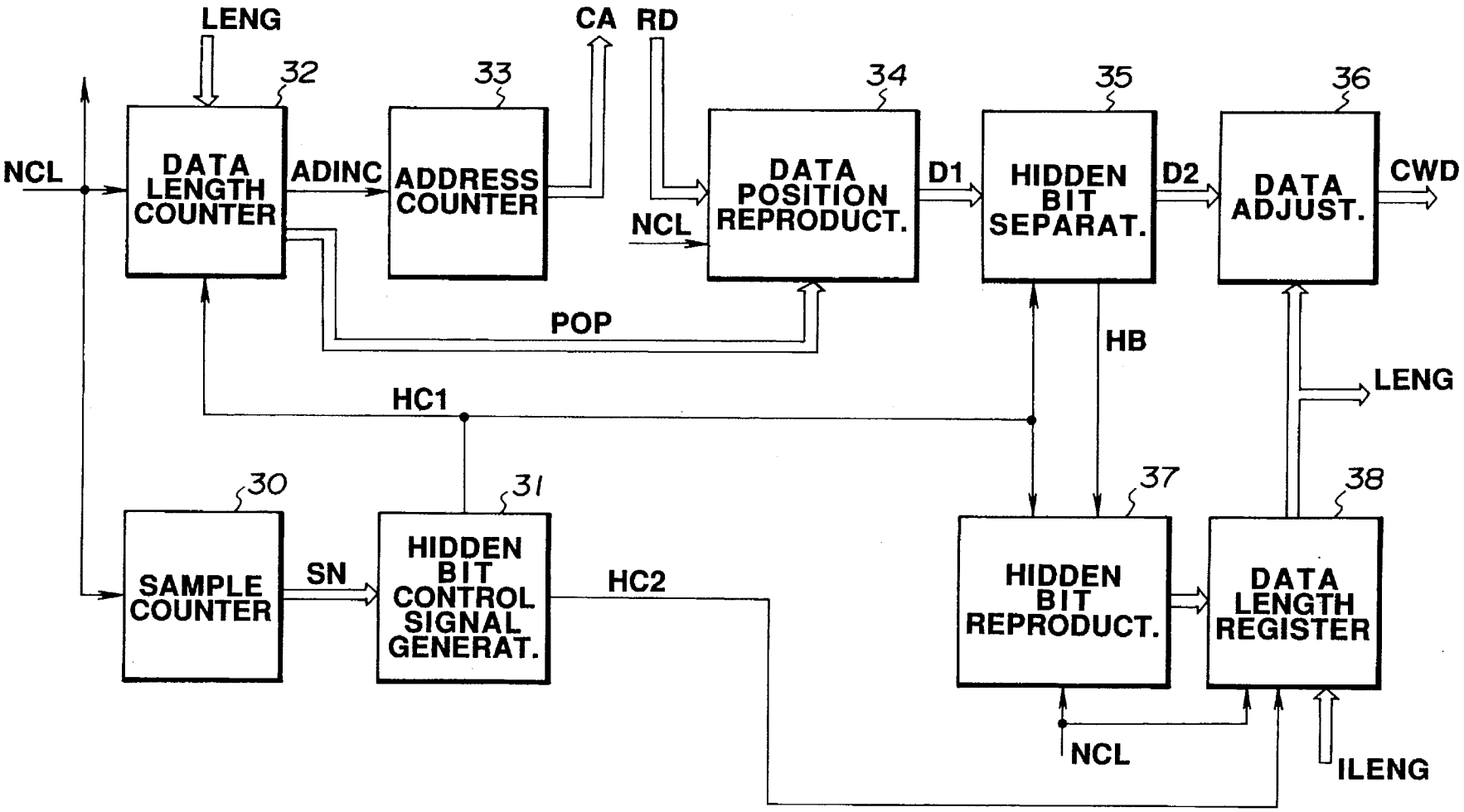
FIG. 4 is a block diagram showing an example of internal construction of a data takeout and reproduction section in FIG. 1.

FIG. 4 is a block diagram showing an example of the internal construction of the data takeout and reproduction section 20. The note clock pulse NCL which commands reading of data for each sample point is applied to a sample counter 30, a data length counter 32, an address counter 33, a data position reproduction circuit 34, a hidden bit reproduction circuit 37 and a data length register 38.

Figure 5:
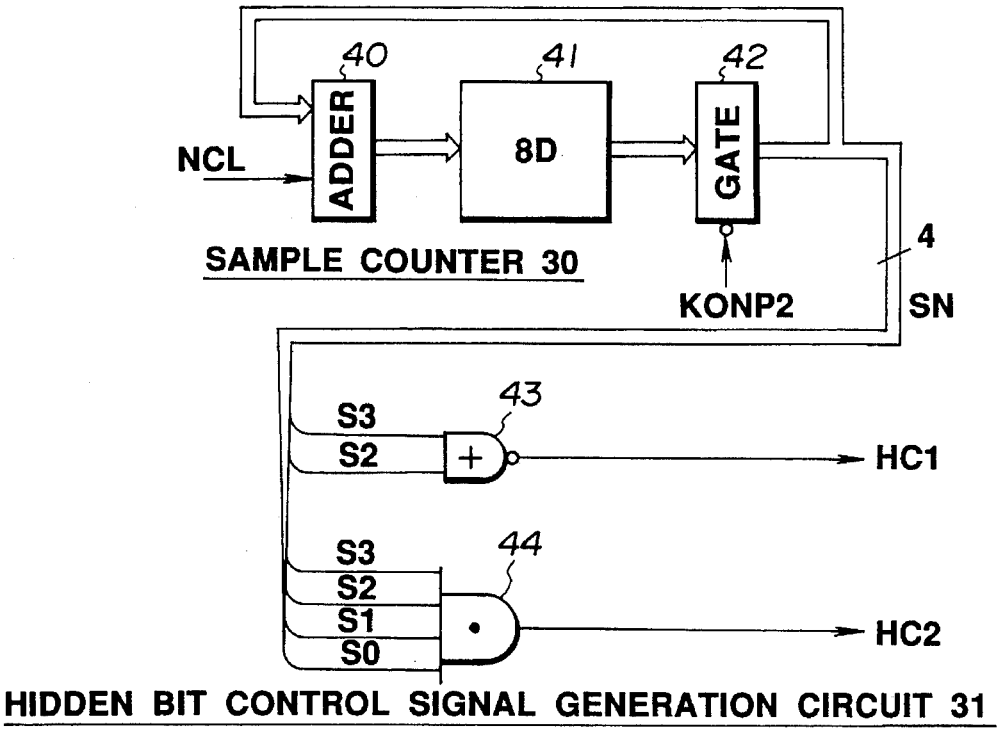
FIG. 5 is a block diagram showing a specific example of a sample counter and a hidden bit control signal generation circuit in FIG. 4.

The sample counter 30 counts the note clock pulse NCL and produces a sample number SN which designates the number of a sample point to be reproduced by a relative number within one frame. A specific example of the sample counter 30 is shown in FIG. 5. The sample counter 30 comprises an adder 40, an 8-stage 4-bit shift register 41 and a gate 42 which gates the output of the shift register 41. The output of the gate 42 is provided as the sample number SN. This 4-bit sample number SN identifies a relative sample number 0–15 within one frame. The gate 42 is closed by the second key-on pulse KONP2 and otherwise is in an open state. The reference characters "8D" in the block of the shift register 41 denotes that the shift register 41 has 8 stages. The shift register 41 is shift-controlled by the two phase system clock pulses $\phi 1$ and $\phi 2$ in synchronism with the channel time division timing. The other shift registers designated by the reference characters 8D have also 8 stages and are shift-controlled in the same manner.

According to this construction, the sample counter 30 is cleared once at the initial stage of key depression by the second key-on pulse KONP2 and thereafter counts the note clock pulse NCL and thereby generates the sample number SN designating the number of the sample point to be reproduced by the relative number 0–15 within one frame.

The generated sample number SN is applied to a hidden bit control signal generation circuit 31. This circuit 31 recognizes the initial four sample points in one frame to which the hidden bits HB0 to HB3 are assigned and also recognizes the last sample point in the frame. A specific example of this hidden bit control signal generation circuit 31 is shown in FIG. 5. The circuit 31 comprises a NOR gate 43 to which MSB S3 and the second highest order bit S2 of the 4-bit sample number SN are applied and an AND gate 44 to which all bits S3, S2, S1 and S0 of the sample number SN are applied. At the initial four sample points in one frame, the MSB S3 and second highest order bit S2 of the sample number SN are all "0" so that the output of the NOR gate 43 is "1" but otherwise the output of the NOR gate 43 is "0". The output of this NOR gate 43 is supplied to the other circuits as a hidden cit control signal HC1. When this signal HCL is "1", it represents a sample point to which the one of the hidden bits HB0 to HB3 is assigned. At the sample point in the frame, all bits of the sample number SN are "1" so that the output of the AND gate 44 is turned to "1" and this signal is supplied to the other circuits as a frame change signal HC2.

The data length counter 32 is a counter of modulo 16 which receives the data length designation data LENG provided by a data length register 38 and accumulates this data at each timing of the note clock pulse NCL. This modulo number 16 corresponds to the bit number 16 of one address in the memory 10. Accordingly, the count value of the data length counter 32 designates a border of the data of variable data length in the memory address.

Figure 6:
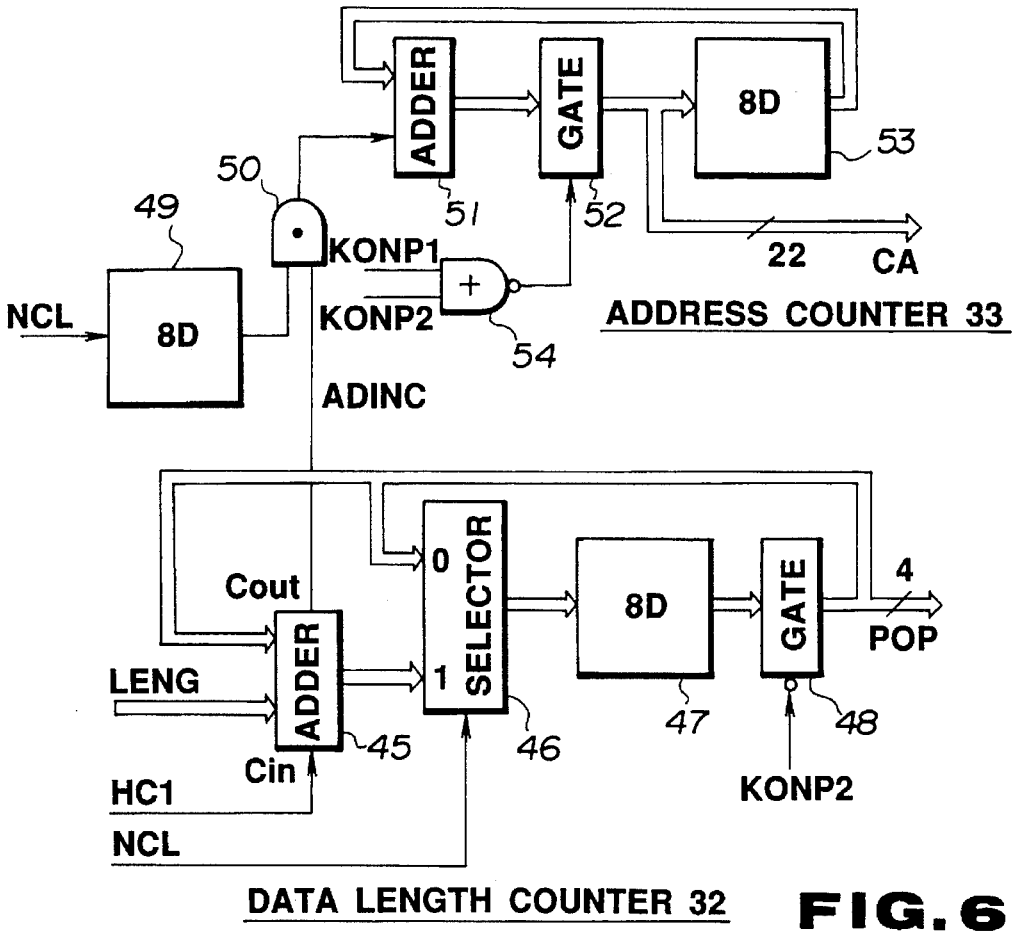
FIG. 6 is a block diagram showing a specific example of a data length counter and an address counter in FIG. 4.

A specific example of the data length counter 32 is shown in FIG. 6. The data length counter 32 comprises an adder 45, a selector 46 which receives result of addition by the adder 45 at "1" input, an 8-stage 4-bit shift register 47 which receives the output of the selector 46 and stores it dynamically for each channel in synchronism with the time division timing and a gate 48 which gates the output of the shift register 47. The output of the gate 48 is applied to a "0" input of the selector 46. The gate 48 is closed by the second key-on pulse KONP2 but otherwise is in an open state. The selector 46 selects and holds result of addition of the adder 45 applied to the "1" input when the note clock pulse NCL has been generated (= "1") and selects and holds a count applied to its "0" input when the note clock pulse NCL has not been produced (= "0").

According to this construction, the data length counter 32 is cleared once at the initial stage of key depression by the second key-on pulse KONP2 and thereafter accumulates the data length designation data LENG each time the note clock pulse NCL has been produced. The data length designation data LENG designates net data length of the waveform data portion and does not designate data length including the hidden bits HB0 to HB3. For enabling actual data length to be added at the sample points including the hidden bits HB0 to HB3, the hidden bit control signal HC1 is applied to a carry-in input Cin of the adder 45 so that 1 addition is added for a hidden bit. The count output of the data length counter 32 is provided from the gate 48 and this is supplied to other circuits as a pull out pointer (takeout pointer) POP. This pull out pointer POP designates a bit position in the memory address at which LSB of the data for one sample point to be taken out is stored.

In the case of FIG. 3, for example, the pull out pointer POP of the first sample point 0 designates "0", i.e., LSB 0 in the memory address, by clearing by the key-on pulse KONP2. Upon arrival of a timing of the next note clock pulse NCL, addition of 1 is made in the adder 45 due to 11 of the data length data LENG and 1 of the hidden bit control signal HC1, so that the pull out pointer POP becomes 12 and designates bit 12 in the memory address. Upon arrival of a timing of the next note clock pulse NCL, "1" is produced at a carry output Cout of the adder 45 since 12+12= 24 and result of addition becomes 8. Bit 8 of the memory address therefore is designated. In this manner, the pull out pointer POP designates a bit position in the memory address at which LSB of the data for one sample point is stored.

The signal of the carry output Cout of the adder 45 is provided from the data length counter 32 as an address increment pulse ADINC.

The address counter 33 performs address counting for accessing the waveform memory 10 in response to the address increment pulse ADINC and the note clock pulse NCL and produces the address signal CA which is a relative value of the read address. The address is counted up by 1 by using the address increment pulse ADINC produced at the timing of the note clock pulse NCL as an effective address increment pulse.

A specific example of the address counter 33 is shown in FIG. 6. The address counter 33 comprises an 8-stage 1-bit shift register 49 which delays the note clock pulse NCL, an AND gate 50 which receives the output of this shift register 49 and the address increment pulse ADINC, an adder 51 which receives the output of the AND gate 50 at one input thereof, a gate 52 which gates a result of addition of the adder 51 and an 8-stage 22-bit shift register 53 which receives the output of the gate 52 and and stores it dynamically for each channel in synchronism with the time division timing. The output of the shift register 53 is applied to the adder 51 and added to the output of the AND gate 50. The key-on pulses KONP1 and KONP2 are applied to the NOR gate 54 and the gate 52 is controlled by the output of the gate 54.

The timing at which a carry output is produced from the adder 45 in the data length counter 32 is delayed by 8 system clocks from the timing of the note clock pulse NCL due to the delay in the shift register 47. For synchronizing with this timing, the note clock pulse NCL is delayed by 8 system clocks by the shift register 49. Accordingly, when the address increment pulse ADINC has been produced as a result of addition of the data length designation data LENG at a timing of the note clock pulse NCL, the output of the AND gate 50 is turned to "1" and the address counter 33 counts up one address. In the address counter 32, the output of the gate 52 is provided as the address signal CA.

In the case of FIG. 3, for example, the address signal CA initially designates "0", i.e., memory address A0 by clearing by the key-on pulses KONP1 and KONP2 and the data of 16 bits stored at this address A0 is read out. Upon arrival of the next timing of the note clock pulse NCL, the addition output of the adder 45 of the data length counter 32 becomes 12 as was described before and this addition output is selected by the selector 46 and applied to the shift register 47 and, 8 system clocks thereafter, POP= 12 is provided. At this time, 12 is further added in the adder 45 and the carry output Cout therefore becomes "1". The address increment pulse ADINC which is "1" and the note clock pulse NCL which has been delayed by 8 system clocks are applied to the AND gate 50 thereby causing the address counter 33 to count up. The address signal CA therefore designates "1", i.e., the memory address A1 and the data of 16 bits stored at this address is read out. On the other hand, the output of the adder 45 is not selected by the selector 46, so that the output POP of the data length counter 32 maintains 12.

As will be readily understood, as regards the data of the sample number 1 stored over the two addresses A0 and A1, the pull out pointer POP designates the bit 12 at the address A0 at which the LSB of the data is stored and the address signal CA which is the output of the address counter 33 designates the next address A1. In other words, the address signal CA precedes the pull out pointer POP by 1 address. This is because, as will be described later, the data position reproduction circuit 34 temporarily holds data of the preceding address which has been read from the waveform memory 10 in order to reproduce data for one sample point stored over two addresses and the pull out pointer POP designates LSB of the data to be taken out to the temporarily held data read from the preceding address.

The data position reproduction circuit 34 receives data RD of 16 bits which has been read from the waveform memory 10 and performs (a) a function of reproducing data for one sample point stored over two addresses after assembling it to a set of data and (b) a function of executing a pretreatment for taking out a necessary portion only of the data for one sample point of variable data length from among data of 16 bits by executing a processing for aligning the bit position of the data to LSB of the data of variable data length.

Figure 7:
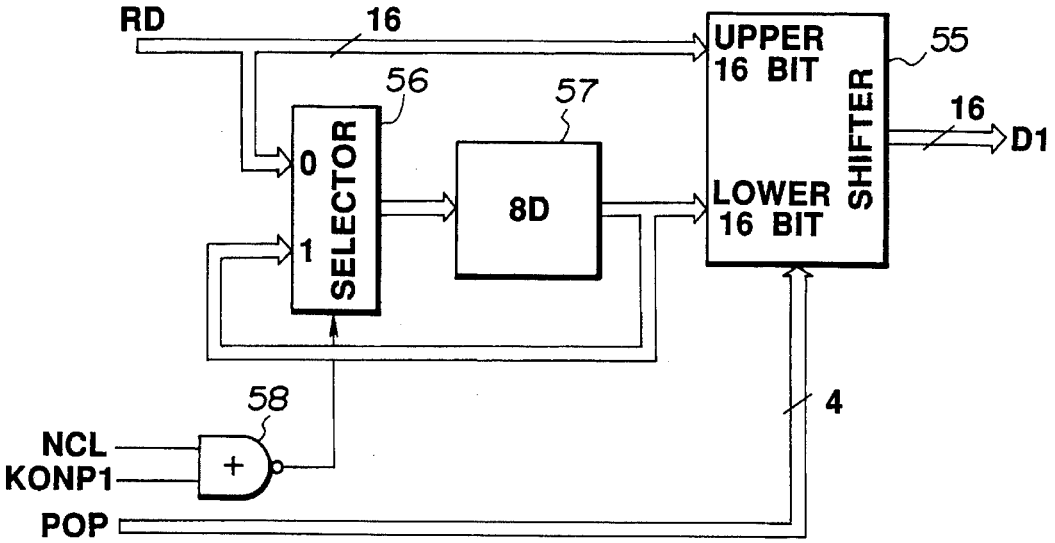
FIG. 7 is a block diagram showing a specific example of a data position reproduction circuit in FIG. 4.

A specific example of the data position reproduction circuit 34, as shown in FIG. 7, comprises a shifter 55 of 32-bit parallel input and 16-bit parallel output type. To upper 16 bit inputs of the shifter 55 are directly applied the data RD of 16 bits which has been read from the waveform memory 10. This read out data RD is applied to a "0" input of a selector 56. The output of the selector 56 is applied to an 8-stage 16-bit shift register 57 and the output of the shift register 57 is applied to a "1" input of the selector 56 and also to lower 16 bit inputs of the shifter 55. The note clock pulse NCL and the key-on pulse KONP1 are applied to a NOR gate 58 and, when the output signal of the NOR gate 58 is "0", the "0" input of the selector 56 is selected and, when the output signal of the NOR gate 58 is "1", the "1" input is selected.

To a control input of the shifter 55 is applied the pull out pointer POP from the data length counter of FIG. 6. This pull out pointer POP designates a bit which corresponds to the LSB of the data to be taken out as 16 bit parallel output data from 32 bit parallel input data in the shifter 55. When, for example, POP is 0, the LSB of the 32 bit parallel input data is determined as the LSB of the 16 bit parallel output data and 16 bit data including this bit and higher bits is taken out. When POP is 1, the next bit to the LSB of the 32 bit parallel input data is determined as the LSB of the 16 bit parallel output data and 16 bit including this bit and higher bits is taken out. When POP is 12, the thirteenth bit from the LSB of the 32 parallel input data is determined as the LSB of the 16 bit parallel output data and 16 bit data including this bit and higher bits is taken out.

In the 32 bit parallel input of the shifter 55, 16 high order bits are the data RD which is currently read out and 16 low order bits which are supplied from the shift register 57 are data which have been read from the immediately preceding address. Data which have been read from the two addresses are loaded side by side in the shifter 55 and, in a case where data for one sample point is stored in two addresses, necessary data for one sample point can be taken out of 32 bit parallel data of the two addresses stored in the shifter 55.

Since the pull out pointer POP designates LSB of data of variable data length, a processing for aligning the bit position of data to the LSB of the data of variable data length can be performed by designating, by the pull out pointer POP, the input bit position of data to be taken out as LSB of 16 bit parallel output data. By this method, a pretreatment for taking out a necessary portion only of data of variable data length for one sample point from 16 bit data can be realized.

Figure 10A:
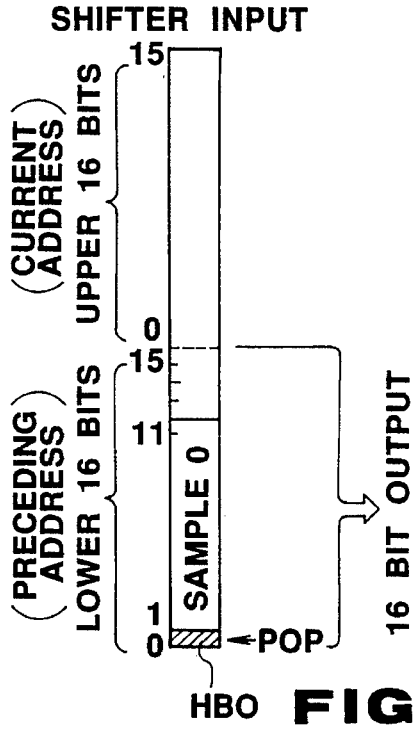
FIGS. 10*a* and 10*b* are diagrams for explaining an example of operation of a shifter in FIG. 7.

Referring to FIG. 3, for example, the address signal CA becomes "0" by clearing the address counter 33 of FIG. 6 when the first key-on pulse KONP1 has been produced and data is thereby read from the address A0. The selector 56 selects data RD read from the address A0 in response to the output "0" of the NOR gate 58 and the selected data RD is loaded in the shift register 57. In the next cycle, the selector 56 selects the output of the shift register 57 in response to the output "1" of the NOR gate 58 and storage of the read out data RD from the address A0 is held. The pull out pointer POP at this time is "0" so that 16 low order bits of the input data in the shifter 55, i.e., the read out data from the address A0 held in the shift register 57, is directly selected and taken out. This data includes the data for the sample point 0 in its 12 low order bits. In other words, the data for the sample point 0 to be taken out first is taken out in its entirely with its LSB being aligned with the LSB of the 16 bit output. This arrangement is schematically illustrated in FIG. 10*a*.

Figure 10B:
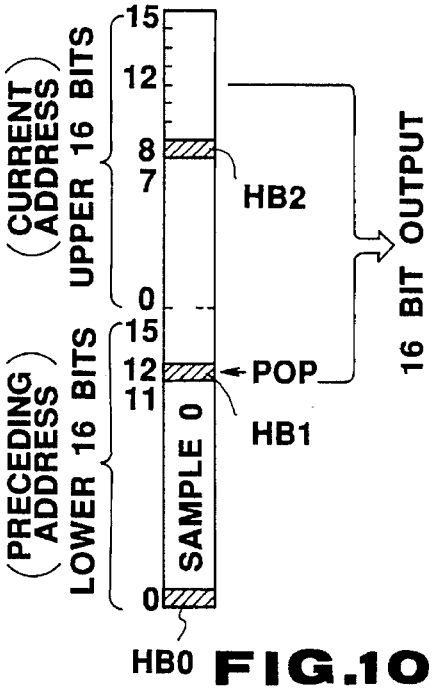

Then, upon generation of the note clock pulse NCL, the pull out pointer POP becomes "12" upon lapse of 8 system clocks thereafter as described above and the address signal CA changes to address A1 (see FIG. 6). Since, however, the note clock pulse NCL applied to the NOR gate 58 has not been delayed, the address signal CA has not changed when the output of the NOR gate 58 turns to "0" by this note clock pulse NCL and, therefore, the read out data RD from the address A0 is selected by the selector 56 and stored in the shift register 57. Accordingly, when the read address of the waveform memory 10 has changed to A1 8 system clocks thereafter and the read out data RD from the address A1 is applied to 16 high order bits of the shifter 55, preceding read out data from the address A0 is supplied from the shift register 57 to 16 low order bits. In this manner, read out data from two consecutive addresses are arranged in parallel in the input of the shifter 55. At this time, the pull out pointer POP is "12" designating the LSB position of the data for the sample point 1 at the preceding address A0. Therefore, data of 16 bits with its LSB corresponding to the LSB of the data for the sample point 1 is taken out of the shifter 55. This data includes the data for the sample point 1 in its entirety in 12 low bits. In this manner, the data for the sample point 1 stored separately at two addresses are provided as a set of data with its LSb being aligned with the LSB of the 16 bit output. This arrangement is schematically shown in FIG. 10*b*.

Thus, 16-bit data D1 in which the object data to be taken out and having variable data length is arranged in the order of its bit positions sequentially from LSB is provided by the shifter 55. Since this 16-bit data D1 may contain unnecessary data on its higher bit side, the object data for one sample point of variable data length only has not been taken out yet. For taking out this data only, further processing is required.

Reverting to FIG. 4, the data D1 produced from the shifter 55 of the data position reproduction circuit 34 is applied to a data adjustment circuit 36 through a hidden bit separation circuit 35. The hidden bit separation circuit 35 separates the hidden bits HB0 to HB3 when the data D1 contains them and takes out net waveform data only and supplies this net waveform data as data D2 to the data adjustment circuit 36. The data adjustment circuit 36 is provided for taking out the object data for one sample point having variable data length only from the data D2. A 1-bit potential hidden bit signal HB (this is a signal which has possibility of being one of the hidden bits HB0 to HB1) which has been separated by the hidden bit separation circuit 35 is applied to a hidden bit reproduction circuit 37. The hidden bit reproduction circuit 37 reproduces, in response to the potential hidden bit signal HB supplied from the hidden bit separation circuit 37, a set of 4-bit hidden bits HB0 to HB3 and thereby exposes the 4-bit hidden information HD which has been stored separately in the form of the hidden bits HB0 to HB3. As described above, in this embodiment, data length designation information for the next frame is stored as the hidden information HD. The reproduced hidden information HD, i.e., data length designation information for the next frame, is supplied to a data length register 38.

Figure 8:
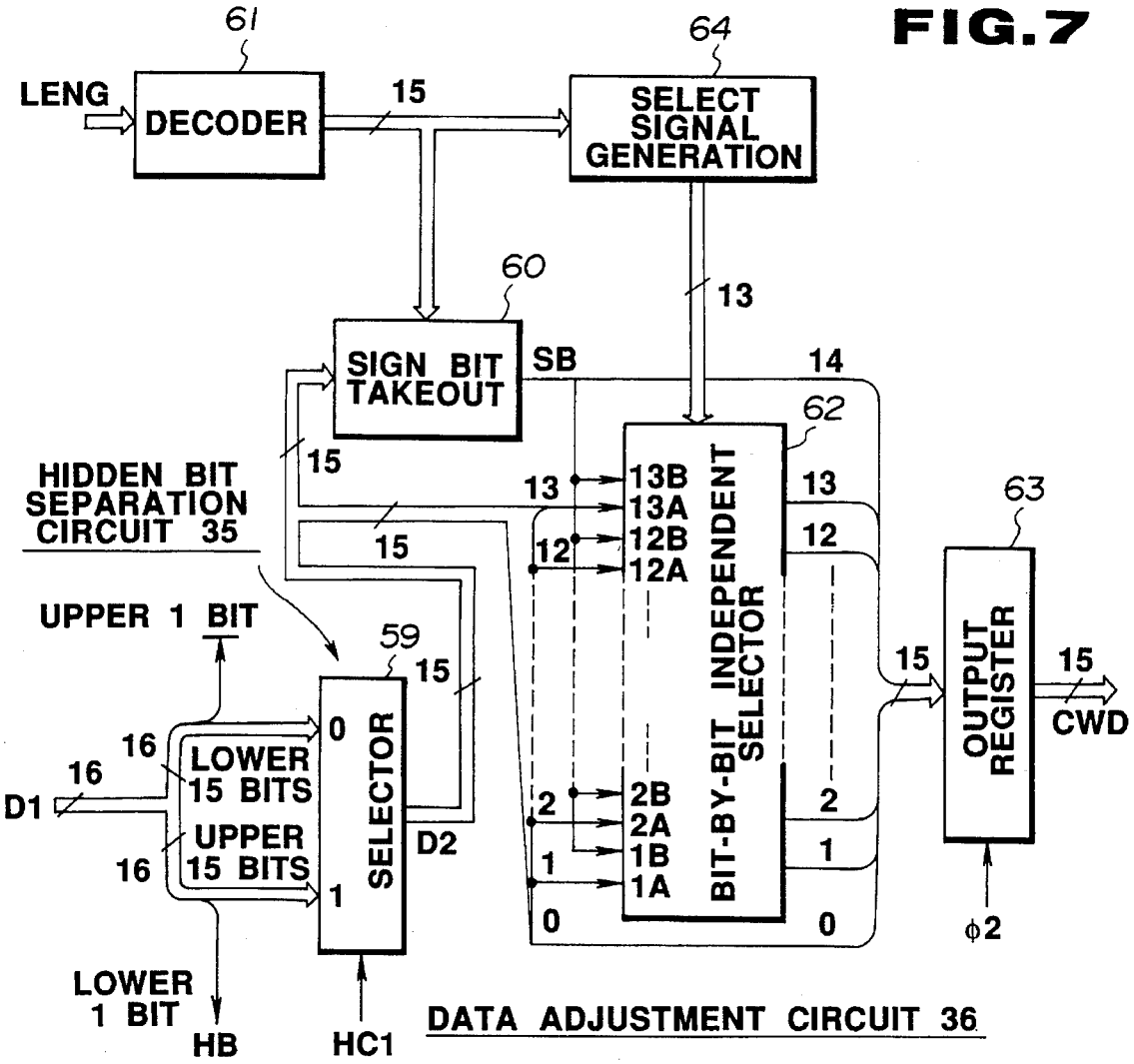
FIG. 8 is a block diagram showing a specific example of a hidden bit separation circuit and a data adjustment circuit in FIG. 4.

A specific example each of the hidden bit separation circuit 35 and the data adjustment circuit 36 is shown in FIG. 8.

In this embodiment, data length, i.e., size, of net waveform data is variable data length in the range of 2 bits to 15 bits. Accordingly, maximum data length of effective data is 16 bits when it includes a hidden bit and 15 bits when it does not include a hidden bit. Therefore, the maximum data length of the effective data of the data D1 which may include a hidden bit is 16 bits and, for this reason, this data D1 is taken out as 16 bit data. The maximum data length of the effective data of the data D2 after separation of the hidden bit is 15 bits.

In FIG. 8, the hidden bit separation circuit 35 is made of a selector 59 to which lower 15 bits of the data D1 are applied to its "0" input and upper 15 bits are applied to its "1" input. The selector 59 receives the above described hidden bit control signal HC1 (see FIG. 5) at its selection control input and selects "1" input when HC1 is "1" and selects "0" input when HC1 is "0". When, therefore, data for the first four sample points in the frame including the hidden bits HB1 to HB3 is to be taken out, the upper 15 bits of the data D1 are selected by "1" of HC1 and one of the hidden bits HB0 to HB3 located at the least significant one bit is excluded. The 15-bit data is sufficient for securing effective bits of the above described net waveform data. When, on the other hand, data for a sample point which does not include the hidden bits HB0 to HB3 is to be taken out, lower 15 bits of the data D1 are selected by "0" of HC1. This 15-bit data also is sufficient for securing effective data of the above described net waveform data.

The 15-bit net waveform data D2 which has excluded the hidden bit is applied to the data adjustment circuit 36. As was described previously, this data D2 may contain not only the object waveform data for one sample point but also waveform data for next sample point.

If the object waveform data for one sample point is taken out with its data length remaining variable in taking this data only from the data D2, inconvenience will arise in subsequent data processing. The data adjustment circuit 36 therefore adjusts the taken out data to the data size of 15-bit fixed data length. For this purpose, the data adjustment circuit 36 takes out the object waveform data for one sample point from the data D2 first and, when the taken out waveform data for one sample point does not satisfy the data size of 15-bit fixed data length, executes processing for expanding the sign bit to all empty high order bits and thereby adjusts the size of the entire data to the fixed data length of 15 bits while taking out the object waveform for one sample point only.

In the data adjustment circuit 36 of FIG. 8, the data D2 is applied to a sign bit takeout circuit 60 for taking out a sign bit SB. The data length designation data LENG is decoded by a decoder 61 and one output line corresponding to MSB of the data of variable data length in 15 output lines of the decoder 61 becomes a signal "1". By this output of the decoder 61, the position of the sign bit SB to be taken out in the sign bit takeout circuit 60 is designated. When, for example, the data length is 10 bits, the tenth bit of the data D2 is the MSB of the data of variable data length, i.e., the sign bit. This signal is taken out in response to "1" of the tenth output line of the decoder 61.

In the data adjusting circuit 36 in FIG. 8, a bit-by-bit independent selector 62 selects the object waveform data for one sample point only and excludes a part of data for other sample point to expand the sign bit SB instead of it. Since the data of LSB 0 in 14 low order bits of the data D2 (the MSB may be excluded because the MSB cannot be any other bit than the sign bit and this sign bit can be identified by an output of a sign bit takeout circuit 60) is always data of the object waveform data for one sample point, this data is not applied to the selector 62 but may be applied directly to an output register 63. Data of the other bits excluding the LSB of the 14 low order bits of the data D2 are applied to bit-by-bit A inputs 1A to 13A of the selector 62. A signal representing the sign bit SB provided by the sign bit takeout circuit 60 is applied commonly to bit-by-bit inputs 1B to 13B of the selector 62. The bit-by-bit selection control in the selector 62 is achieved by signals supplied on 13 signal lines from a select signal generation circuit 64. The select signal generation circuit 64 provides, in response to the output signal of the decoder 61, a selection control signal "1" in correspondence to all of higher order bits from the bit position of the sign bit SB.

Assume, for example, that the sign bit SB is the bit 1 which is the second lowest bit in the data D2. In this case, signals on the 13 signal lines of the select signal generation circuit 64 become "1" and the bit-by-bit independent selector 62 select the sign bit SB of the B-inputs 1B to 13B at all of the bits. In a case where the sign bit SB is the bit 2 which is the third lowest bit in the data D2, a signal on one low order signal line of the select signal generation circuit 64 becomes "0" and signals on the 12 high order signal lines become "1" and the bit-by-bit independent selector 62 selects the waveform data of the A input 1A at the bit 1 and the sign bit SB of the B inputs 2B to 13B at the bits 2 to 13. In a case where the sign bit is the bit 3 which is the fourth lowest bit in the data D2, signals on two low order signal lines of the select signal generation circuit 84 become "0" and signals on 11 high order signal lines become "1" and the bit-by-bit independent selector 62 selects waveform data of the A inputs 1A and 2A at the bits 1 and 2 and selects the sign bit SB of the B inputs 3B to 13B at the bits 3 to 13. Similarly, as the position of the sign bit SB is shifted, the mode of bit-by-bit selection is also shifted and, as a result, the object waveform data for one sample point is selectively taken out and data of other sample point is excluded to expand the sign bit SB instead of it.

The 15-bit data consisting of the LSB of the data D2, the 13-bit output data of the selector 62 and the sign bit SB which has been taken out of the sign bit takeout circuit 60 is applied to the output register 63 and is loaded therein at a timing of rising of the system clock pulse $\phi 2$. This timing of rising of the system clock pulse $\phi 2$ occurs within one time slot of the time division channel timing, so that the loading of the data is made when the data in the time division channel timing has sufficiently risen. The output of this output register 63 is provided as waveform data CWD for one sample point which has been taken out.

Figure 9:
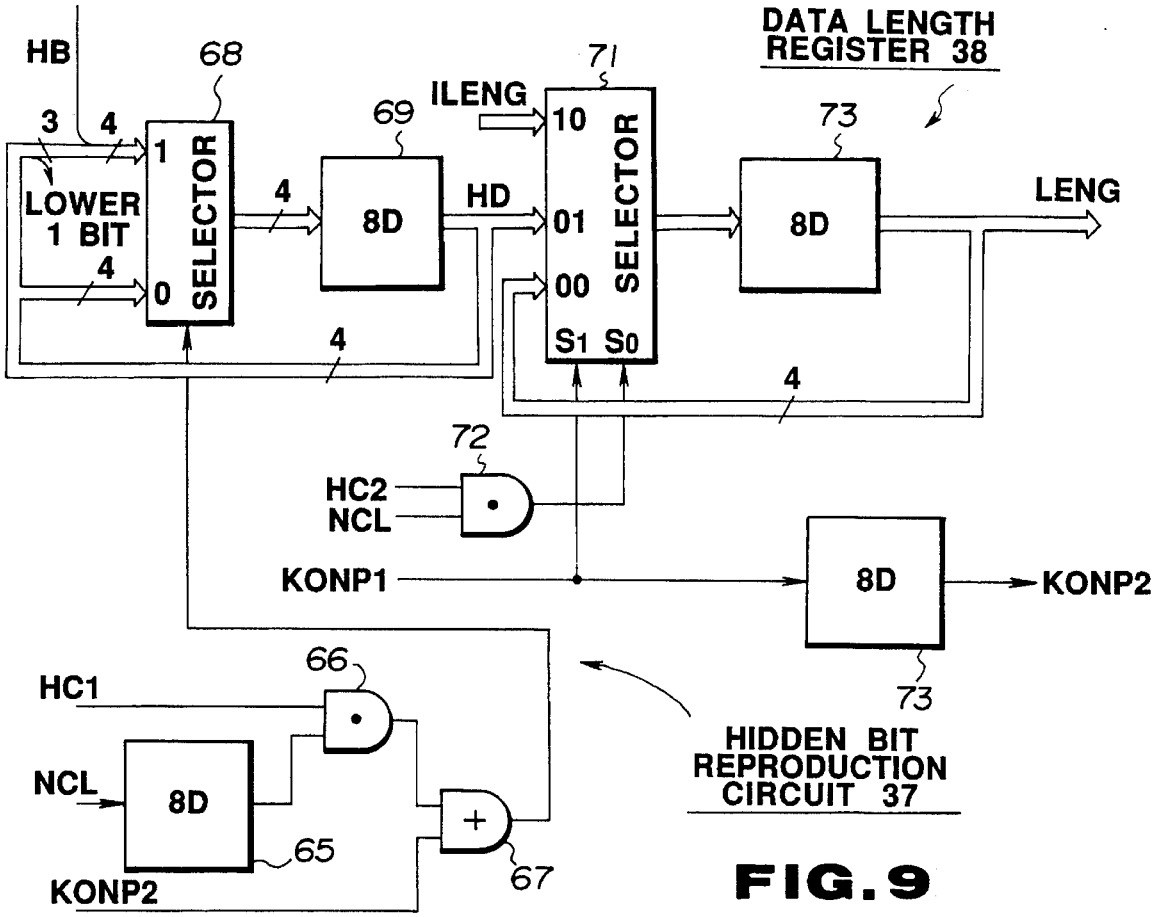
FIG. 9 is a block diagram showing a specific example of a hidden bit reproduction circuit and a data length register in FIG. 4.

The hidden bit reproduction circuit 37 in FIG. 9 includes an AND gate 66 which receives a signal obtained by delaying the note clock pulse NCL by an 8-stage 1-bit shift register 65 and the hidden bit control signal HC1, an OR gate 67 which receives the second key-on pulse KONP2 and the output of the AND gate 66, a selector 68 which is controlled by the output the OR gate 67 and an 8-stage 4-bit shift register 69 which receives the output of the selector 68. The output of the shift register 69 is applied directly to a "0" input of the selector 68. To the MSB of 4 bits of "1" input of the selector 68 is applied a signal of the LSB of the data D1, i.e., the potential hidden bit signal HB. To the remaining 3 low order bits of the 4 bits of the "1" input of the selector 68 is applied data obtained by shifting the output of the shift register 69 by one bit to the lower order bit side.

According to this construction, when the second key-on pulse KONP2 has become "1", the "1" input of the selector 68 is selected in response to the output "1" of the OR gate 67. As the data D1, data for the sample point 0 which has been read out from the address A0 by address clearing by the first key-on pulse KONP1 which was produced one cycle before is provided while the hidden bit HB0 stored with respect to the sample point 0 is provided as the potential hidden bit HB. Since the output of the shift register 69 may take any value initially, explanation will be made by designating this output by x (x may be either 0 or 1). By the above arrangement, 4-bit data having contents of HB0, x, x, x (in the order from the MSB is loaded in the shift register 69 through the "1" input of the selector 68. In the next cycle, the output of the OR gate 67 becomes "0", so that the data HB0, x, x, x loaded in the shift register 69 is held by the shift register 69 through the "0" input of the selector 68.

Then, when the note clock pules NCL has been produced and data for the sample point 1 has been given as the data D1, the output of the AND gate 66 is turned to "1" due to HC1 which is "1" and the delay output "1" of the note clock pulse NCL (since the delay by the shift register 65 is synchronized with HC1, see FIG. 5) and, as a result, the output of the OR gate 67 is turned to "1" and the "1" input of the selector 68 is thereby selected. At this time, the hidden bit HB1 which has been stored with respect to the sample point 1 is provided as the potential hidden bit HB, the 4-bit data of HB1, HB0, x, x (in the order from the MSB), is loaded in the shift register 69 through the "1" input of the selector 68. In the next cycle, the output of the OR gate 67 becomes "0" and the data HB1, HB0, x, x which has been loaded in the shift register 69 is held therein through the "0" input of the selector 68.

Then, when the next note clock pulse NCL has been produced and the data for the sample point 2 has been provided as the data D1, the hidden bit HB2 which has been stored with respect to the sample point 2 is provided as the potential hidden bit signal HB, so that the data HB2, HB1, HB0, x is loaded and held in the shift register 69 in the same manner as described above.

When the next note clock pulse NCL has been produced and the data for the sample point 3 has been provided as the data D1, the hidden bit HB3 which has been stored with respect to the sample point 3 is provided as the potential hidden bit HB and the data HB3, HB2, HB1, HB0 is loaded and held in the shift register 69 in the same manner as described above.

Thereafter, in this particular frame, the data HB3, HB2, HB1, HB0 is held in the shift register 69 even when the note clock pulse NCL has been produced, since the hidden bit control signal HC1 is "0" so that the output of the AND gate 66 does not become "1".

Thus, the 4-bit hidden bits HB3, HB1, HB0 are reproduced and held in the shift register 69. These hidden bits are supplied to the data length register 38 as the hidden information HD designating data length of the next frame.

Referring to FIG. 9, the data length register 38 includes an 8-stage 4-bit shift register 69 and a selector 71. To a "10" input of the the selector 71 is applied the initial data length data ILENG and to a "01" input of the selector 71 is applied the above described hidden information, i.e., data designating the data length of the next frame, Further, to a "00" input of the selector 71 is applied the output of the shift register 70. To high order bits of a 2-bit control input of the selector 71 is applied the first key-on pulse KONP1 and to low order bits of this control input is applied the output of the AND gate 72. To the AND gate 72 are applied a frame change signal HC2 from the AND gate 44 in FIG. 5 and the note clock pulse NCL.

According to this construction, when the key-on pulse KONP1 is "1", the selector 71 selects the initial data length data ILENG of the "10" input and loads it in the shift register 70. In the next cycle, the selector 71 selects the "00" input and holds the loaded data ILENG. The output of the shift register 70 is provided as the data length designation data LENG to the respective circuits as described previously. In the first frame, therefore, the initial data length data ILENG produced by the parameter data generation circuit 18 is used as the data length designation data LENG.

In this frame 0, as described above, the hidden information HD designating data length of the next frame is supplied to the selector 71.

Then, upon changing of the frame, the output of the AND gate 72 is turned to "1" and the selector 71 selects the hidden information HD at the "01" input and loads it in the shift register 70. In the next cycle, the selector 71 selects the "00" input and holds the loaded data HD. In this manner, in the second and subsequent frames, the hidden information HD designating the data length which has been stored as hidden information with the waveform data of the preceding frame is used as the data length designation data LENG.

Instead of generating the second key-on pulse KONP2 from the first circuit 17, the second key-on pulse KONP2 may be generated by delaying the first key-on pulse KONP1 by 8 system clock pulses by the 8-stage 1-bit shift register 73 in FIG. 9.

An Example of The Compressed Data Demodulation Circuit

Figure 11:
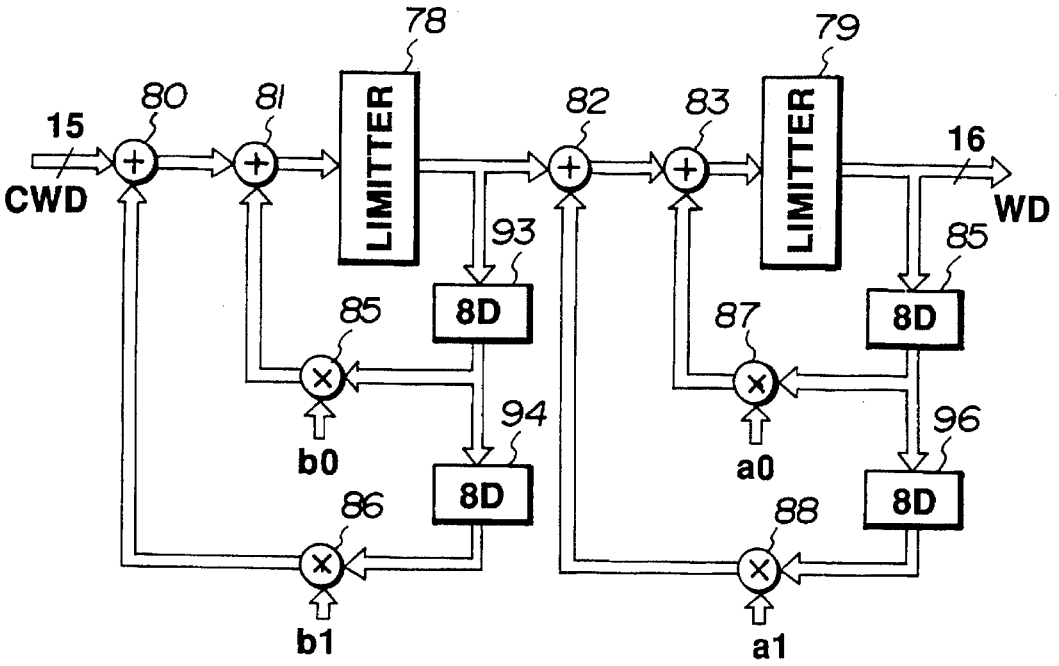
FIGS. 11 and 12 are block diagrams showing an example of a compressed data demodulation circuit in FIG. 1.
Figure 12:
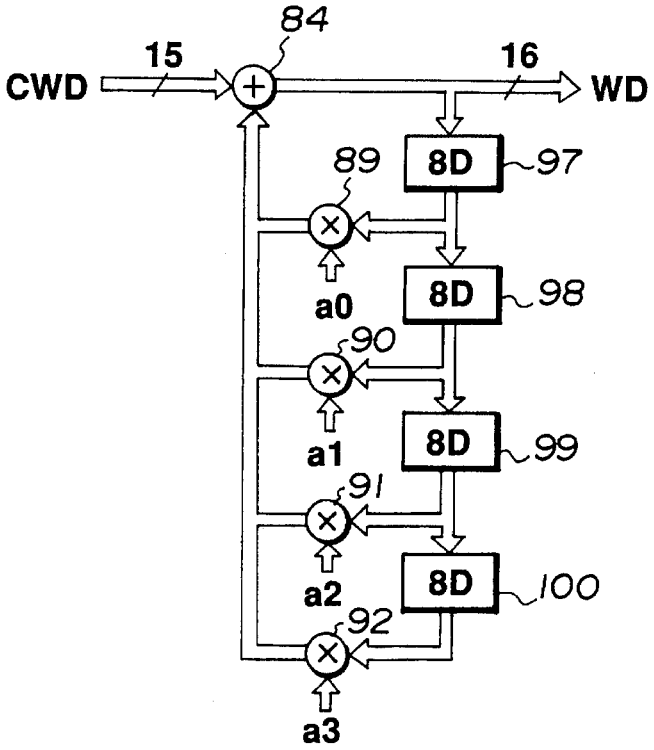

In a case where the waveform data CWD which has been taken out and reproduced by the data takeout and reproduction circuit 20 is compressed by the linear prediction coding system (LPC), the compressed data demodulation circuit 23 shown in FIG. 1 employs an LPC demodulation circuit. In this case, the compressed data demodulation circuit 23 can be constructed of an LPC demodulation circuit as shown in FIG. 11 or 12. In the figures, reference characters 78 and 79 designate limiters, 80 to 84 adders, 85 to 92 multipliers, 93 to 100 8-stage shift registers and a0, a1, b0, b1, a0 to a3 LPC coefficients, respectively. FIG. 11 shows an example of an LPC demodulation circuit of two stages and FIG. 12 shows an example of an LPC demodulation circuit of one stage.

The method of storing and reading data in and from the memory according to the invention is preferable because it enhances saving of the memory capacity further when it is used in combination with such data compression technique. In this case, the data compression method is not limited to the LPC system but any other system such as DPCM, ADCP and delta modulation may be employed. Further, the present invention can be of course applied to a case where the data compression technique is not employed.

Other Embodiments

In the above described embodiment, the present invention is applied to generation of tone waveform data. The present invention can also be applied to generation of various data in an electronic musical instrument such as generation of envelope shape data for determining the tone volume level, generation of envelope shape data for performing various controls, generation of filter coefficient data, generation of other tone color setting data and generation of after-touch data and press data of a sequencer.

In the above described embodiment, it is necessary in the data takeout and reproduction section 20 to perform multi-stage processing stages including sample counting, data length counting, address counting, data position reproduction and hidden bit reproduction and these multi-stage processing stages are performed at a timing of one sample. For this requirement, time for one sample may have to be sufficiently long. For solving this problem, processing over plural sampling timings in the same channel timing may be advantageously executed by a pipe line processing method whereby time for one sample can be shortened and the data reading speed can be increased.

In the above described embodiment, there are three aspects of the invention, namely, (1) the aspect of the invention according to which desired plural data of variable data length are stored and one of the plural data is accurately taken out, (2) the aspect of the invention according to which single data is stored over plural addresses and read out data are connected together to accurately reproduce the single data, and (3) data for single information is divided into plural data and the divided plural data are stored between other data in dispersed form as hidden information and this hidden information is accurately reproduced from among read out data, and these three aspects of the invention are combined together in this embodiment. However, even if one of these aspects is carried out singly, the benefit of efficient utilization of the data memory device resulting in achievement of a more compact circuit design and reduction in the manufacturing cost will be obtained. The invention, therefore, need not necessarily be carried out in the form in which these three aspects are combined together but each of these aspects of the invention may be carried out alone.

In the case of carrying out the aspect (1) of the invention, the data length designation data need not be stored in the form of hidden bits but may be stored in the same manner as ordinary data. In that case, the memory storing the data length designation data may be the same memory storing proper data (a part of the storage area of this memory is utilized) or a different memory. For example, the data length designation data may be stored in a cache memory in a tone source circuit. The data length designation data may also be stored in a compressed form. Instead of storing data length in a memory, data length may be designated by other suitable designation means. In the above described embodiment, data length is designated frame by frame. Alternatively, data length may be for each individual data. The length of frames need not be constant but may be different from one another. In that case, data designating the length of a frame to which a particular data length is applied may be stored or designated together with the data length designation data. The data length designation data need not be 4 bits but may be other suitable bits.

In carrying out the aspect (2) of the invention, data length need not be variable but may be fixed. Such fixed data length is advantageous in a case, for example, where the fixed data bit number for one sample exceeds the bit number of one address. In that case, data must be stored over plural addresses for each address. When the fixed data bit number for one sample point is smaller than the bit number of one address, the capability of storing the data over plural addresses is advantageous in that the data can be stored as closely as possible. In that case, data will be stored over plural addresses at a frequency of once per several samples. The number of addresses over which data for one sample is stored need not be 2 but may be 3 or more. The hidden bit or data length designation data is not always necessary. The manner of reading data from plural addresses over which data for one sample is stored is not limited to that of the above described embodiment according to which data is sequentially read out address by address and read out data of preceding address is temporarily stored in a buffer, but data of plural addresses may be read out on a time shared basis at the same sample timing.

In carrying out the aspect (3) of the invention, contents of hidden information stored by hidden bits are not limited to the information designating data length as in the above described embodiment but may be any type of information. Contents of hidden information may be either related or not related to proper data to be stored. For example, data of the PCM system may be stored as proper data to be stored in floating-point representation and its exponential section data may be stored by means of hidden bits. Alternatively, compressed data may be stored as proper data to be stored and data relating to data compression may be stored by means of hidden bits. Further, filter coefficients of a digital filter and other parameters may be stored by means of hidden bits. Control data relating to tone volume or control data relating to pitch may also be stored by means of hidden bits. A unit of hidden information is not limited to one bit in a dispersed position but hidden information may be stored in a dispersed form by plural bits as a unit or different numbers of bits may be used as a unit of hidden information such as one bit at one address and two bits at another address. A hidden bit may be nonuniformly stored such that it exists at one address and does not exist at another address. A hidden bit may also be stored regularly every certain number of addresses or may be stored regularly throughout all addresses. Proper data to be stored is not limited to data of variable data length as used in the above described embodiment but may be data of fixed data length. The bit number of hidden information is not limited to 4 bits.

The present invention can be applied not only to a completed electronic musical instrument but also to a moduled part of an electronic musical instrument. The invention can also be applied to a device which has no keyboard or switch means for selecting a tone but generates a tone by inputting code information. The invention can also be applied to a device which has no tone signal generation unit or a loudspeaker for acoustically sounding a tone but generates data relating to forming or controlling of tone signal. Thus, it will be understood that the term "electronic musical instrument" covers a broad range of devices.

As described in the foregoing, according to the invention, data length of data to be stored in a memory is not fixed but made variable as desired, so that storage cells of the number necessary for effective bits of the data only are occupied and unnecessary storage cells is not occupied. Accordingly, empty storage cells can be utilized for storing other data without being wastefully occupied, which will contribute to efficient use of a memory. Further, since data length of data to be taken out of a memory is designated, object data only can be selectively taken out of the memory in accordance with the designated data length, so that necessary object data only can be taken out without any problem in spite of the fact that the data has variable data length.

What is claimed is:

1. A data generation device comprising:

memory means for storing plural items of data for realizing a given waveform, wherein each of said plural items of data represent a single data value having a desired variable number of bits, each item of data being stored in a memory location corresponding to at least one memory address, with each memory address corresponding to a predetermined plurality of bits;

data length designation means for designating the number of bits corresponding to each item of data to be retrieved in sequence from the memory means, wherein the designated number of bits may include a number other than a multiple of the number of said predetermined plurality of bits;

reading means for reading a predetermined number of bits from said memory means in accordance with an address signal; and takeout means for selectively taking out necessary items of data from said data read out from the memory means in accordance with the designated number of bits, so that a sequence of said items of data for realizing said given waveform, whose number of bits changes in lapse of time in the process of realizing said given waveform, is reproduced.

2. A data generation device as defined in claim 1 wherein:

said memory means has a plurality of memory addresses of fixed bit length, the items of data having a variable number of bits being stored at the memory addresses, and each of the memory addresses is accessed by an address signal; and said takeout means comprises (a) address generation means for generating an address signal, in response to a data readout command, by determining at least one address for reading a necessary item of data from said memory means in accordance with the designated number of bits, data stored in said memory means being read out from said memory means by the generated address signal, and (b) data adjustment means for taking out data corresponding to the designated number of bits from output data of said memory means which has been read out by the address signal.

3. A data generation device as defined in claim 1 wherein items of data to be stored in the memory means are grouped into plural data groups and wherein the number of bits of items of data is such that a common number of bits is used for plural items of data belonging to the same data group and said data length designation means designates number of bits for each of the data groups.

4. A tone generation device as defined in claim 1 wherein said data length designation means stores information designating the number of bits of data items stored in said memory means, reads out the information designating the number of bits of certain data items prior to taking out the data items from said memory means, and thereby designates the number of bits of the data items in taking out the data items from said memory means.

5. A data generation device as defined in claim 4 wherein the information designating the number of bits is stored in a part of a storage area of said memory means.

6. A data generation device as defined in claim 4 wherein the information designating the number of bits is stored in a memory circuit other than said memory means.

7. A data generation device as defined in claim 1 wherein data to be stored in said memory means is tone waveform data for an electronic musical instrument and each item specifies a sample value of a tone waveform.

8. A data generation device as defined in claim 1 wherein data to be stored in said memory means is envelope shape data for an electronic musical instrument and each item specifies an envelope value for a tone.

9. A data generation device as defined in claim 1 wherein data to be stored in said memory means is parameter data for controlling a tone to be generated by a tone generating system and each item specifies a parameter value for a tone.

10. A data generation device comprising:

memory means for storing plural items of data each representing a single data value and having a desired variable number of bits, each item of data being stored in a memory location corresponding to at least one memory address, with each memory address corresponding to a predetermined plurality of bits;

data length designation means for designating the number of bits corresponding to each item of data to be retrieved in sequence from the memory means, wherein the designated number of bits may include a number other than a multiple of the number of said predetermined plurality of bits;

reading means for reading a predetermined number of bits from said memory means in accordance with an address signal; and takeout means for selectively taking out necessary items of data from said data read out from the memory means in accordance with the designated number of bits, so that a sequence of said items of data, whose number of bits changes in lapse of time, is reproduced, wherein:

said memory means has a plurality of memory addresses of fixed bit length, the items of data having a variable bit length are number of bits being stored at the memory addresses, and each of the memory addresses is accessed by an address signal;

said takeout means comprises:

(a) address generation means for generating an address signal, in response to a data readout command, by determining at least one address for reading a necessary item of data from said memory means in accordance with the designated bit length number of bits, data stored in said memory means being read out from said memory means by the generated address signal; and (b) data adjustment means for taking out data of a number of bits corresponding to the designated bit length number of bits from output data of said memory means which has been read out by the address signal; and said data adjustment means includes means for adding, when the number of bits of the data which has been taken out is less than a predetermined reference bit length number of bits, a data bit or bits corresponding to the deficiency with respect to the reference bit length number of bits to thereby ultimately take out data having a fixed bit length number of bits corresponding to the reference bit length.

11. A data generation device comprising:

memory means for storing a single-value item of data having a plural number of bits in a particular memory location corresponding to plural addresses of the memory means, a memory area identified by each address of the memory means having a capacity corresponding to a predetermined number of bits, wherein the most significant bit of the item of data may be located at any bit position within a particular address;

point out means for pointing out a bit position within an address of most the significant bit or a least significant bit of a data item to be taken out of the memory means; and takeout means for taking out the item of data having said plural number of bits from the memory location in accordance with the position which has been pointed out by said point out means.

12. A data generation device as defined in claim 11 wherein the number of bits of said data item is larger than the number of bits of one address of said memory means.

13. A data generation device as defined in claim 11 wherein the number of bits of said data item is smaller than the number of bits of one address of said memory means.

14. A data generation device as defined in claim 11 wherein said takeout means includes means for adding, when the number of bits of the data item which has been taken out by said takeout means is less than a predetermined reference number of bits, additional data bits to enable data of fixed data length having the reference number of bits to be ultimately produced.

15. A data generation device as defined in claim 11 wherein said takeout means includes reading means for reading out all bits of plural addresses over which said data item is stored, wherein said takeout means arranges all of the bits serially and takes out a necessary segment of bits in response to the position pointed out by said point out means.

16. A data generation device as defined in claim 11 wherein said memory means stores plural data items having a desired variable number of bits, wherein the data generation device further comprises data length designation means for designating a number of bits of a data item to be taken out from the memory means.

17. A data generation device as defined in claim 16 wherein said memory means stores additional data bits other than those forming the data items, said additional data bits representing a number of bits of a data item to be taken out, wherein at least some of said additional data bits are separately stored from one another in locations corresponding to different memory addresses, wherein the data generation device further comprises combining means for combining said additional data bits, and wherein said designation means designates the number of bits based on said combined data bits.

18. A data generation device comprising:

memory means for storing first data items and a second data item, said second data item comprising plural bits and being divided into plural sections, each of the sections being stored in said memory means separately from each other and connected with a different one of said first data items;

reading means for reading out data stored in said memory means address by address;

data separation means for separating the first data items and the sections of the second data item from the data which has been read out by said reading means; and reproduction means for reproducing completed second data item by assembling the respective sections of the second data item which has been separated by said data separation means.

19. A data generation device as defined in claim 18 wherein a section of the separated second data item consists of one bit.

20. A data generation device as defined in claim 18 wherein a section of the separated second data item consists of plural bits.

21. A data storage and reconstruction system for providing plural items of data each having a predetermined common number of bits, comprising:

memory means for storing plural bits corresponding to each of the plural items of data, wherein the plural bits form a first predetermined portion of each respective data item and wherein the number of bits stored for different data items is variable;

readout means for reading stored data items;

bit number means for indicating the number of bits stored for each readout data item;

MSB determining means for determining the value of a most significant bit of the bits stored for each readout data item; and combining means for prefixing the read out bits for each data item with a number of additional bits equal in number to the difference between said common number of bits and the number of bits contained in the particular data item, wherein each additional bit has a value equal to the value determined by the MSB determining means for the particular data item, thereby providing a data item having the common number of bits.

22. A method of storing and retrieving n-bit items of data, comprising the steps of:

dividing at least some of the items of data into a first predetermined portion and a second predetermined portion, wherein a point of division is chosen such that all bits of the second predetermined portion and a most significant bit of the first predetermined portion have the same value;

storing in a memory the first predetermined portion of each data item and information indicating the point of division for each data item;

reading the stored portions and division information from the memory; and reconstructing the second predetermined portions of data items corresponding respectively to the read out first predetermined portions by detecting the value of a most significant bit of each read out portion and prefixing a number of bits of said value to the read out portions on the basis of the read out division information so that the total number of bits is equal to n, thereby providing the n-bit items of data.

23. A data generation device comprising:

memory means having plural addresses each of which has a predetermined number of bit positions, said memory means being provided for storing a single-value item of data of a given number of bits in a certain memory location corresponding to at least two adjacent ones of said plural addresses, said item of data being divided into at least two data portions in correspondence with said at least two adjacent addresses in such a manner that each of said data portions is stored in at least a part of the bit positions of the respective adjacent addresses;

point out means for pointing out a particular bit position within in said predetermined number of bit positions of an address so as to designate a most significant bit or a least significant bit of the item of data to be taken out, wherein the most significant bit or the item of data may be located at any bit position within a particular address; and takeout means for taking out the item of data from the memory location in accordance with the bit position which has been pointed out by said point out means.

* * * * *